US008346116B2

(12) United States Patent
Tsuda et al.

(10) Patent No.: US 8,346,116 B2
(45) Date of Patent: Jan. 1, 2013

(54) IMAGE FORMING APPARATUS

(75) Inventors: Yu Tsuda, Kanagawa (JP); Takaharu Koyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 341 days.

(21) Appl. No.: 12/805,671

(22) Filed: Aug. 12, 2010

(65) Prior Publication Data

US 2011/0121510 A1 May 26, 2011

(30) Foreign Application Priority Data

Nov. 25, 2009 (JP) ..... 2009-267714

(51) Int. Cl.
*G03G 21/20* (2006.01)

(52) U.S. Cl. ..... 399/92; 399/98; 399/100

(58) Field of Classification Search ..... 399/91, 399/92, 98–101
See application file for complete search history.

(56) References Cited

U.S. PATENT DOCUMENTS 5,742,874 A * 4/1998 Koshimura et al. ..... 399/100
7,356,286 B2 * 4/2008 Itabashi et al. ..... 399/170
7,620,342 B2 * 11/2009 Sata ..... 399/92
7,720,430 B2 * 5/2010 Hasegawa et al. ..... 399/397

FOREIGN PATENT DOCUMENTS

JP 2001-235930 A 8/2001

* cited by examiner

*Primary Examiner* — Hoan Tran
(74) *Attorney, Agent, or Firm* — Sughrue Mion, PLLC

(57) ABSTRACT

An image forming apparatus includes: an image carrier; a charging member; a blast port that is provided in almost parallel with a longitudinal direction of the charging member; an air inlet that is provided on one of end sides in the longitudinal direction of the charging member; and a guiding passage that guides, to the blast port, the outside air taken in through the air inlet. A first guiding member is provided in the closest position to an air inlet side of the guiding passage. A second guiding member is provided in almost parallel with the longitudinal direction of the charging member in the guiding passage. A third guiding member is provided on the blast port side from the second guiding member in almost parallel with the longitudinal direction of the charging member in the guiding passage.

9 Claims, 13 Drawing Sheets

IMAGE FORMING APPARATUS

CROSS-REFERENCE TO RELATED APPLICATION

This application is based on and claims priority under 35 USC 119 from Japanese Patent Application No. 2009-267714 filed on Nov. 25, 2009.

BACKGROUND

Technical Field

The present invention relates to an image forming apparatus.

SUMMARY

According to an aspect of the invention, an image forming apparatus includes:

an image carrier;

a charging member that charges a surface of the image carrier;

a blast port that is provided in almost parallel with a longitudinal direction of the charging member, outside air being sent to the charging member through the blast port;

an air inlet that is provided on one of end sides in the longitudinal direction of the charging member and takes the outside air in;

a guiding passage that guides, to the blast port, the outside air taken in through the air inlet;

a first guiding member that is provided in the closest position to an air inlet side of the guiding passage and is formed with a curve from the air inlet side to the blast port side;

a second guiding member that is provided in almost parallel with the longitudinal direction of the charging member in the guiding passage; and a third guiding member that is provided on the blast port side from the second guiding member in almost parallel with the longitudinal direction of the charging member in the guiding passage, wherein the first guiding member is closer to an air inlet side of the guiding passage than the second guiding member and the third guiding member, and wherein an end on the air inlet side of the second guiding member is positioned on the air inlet side from an end on the air inlet side of the third guiding member and a part of the second and third guiding members is provided to overlap with the first guiding member in the longitudinal direction of the charging member.

BRIEF DESCRIPTION OF THE DRAWINGS

Exemplary embodiments of the invention will be described in detail based on the following figures, wherein.

DETAILED DESCRIPTION

[First Embodiment]

Figure 1:
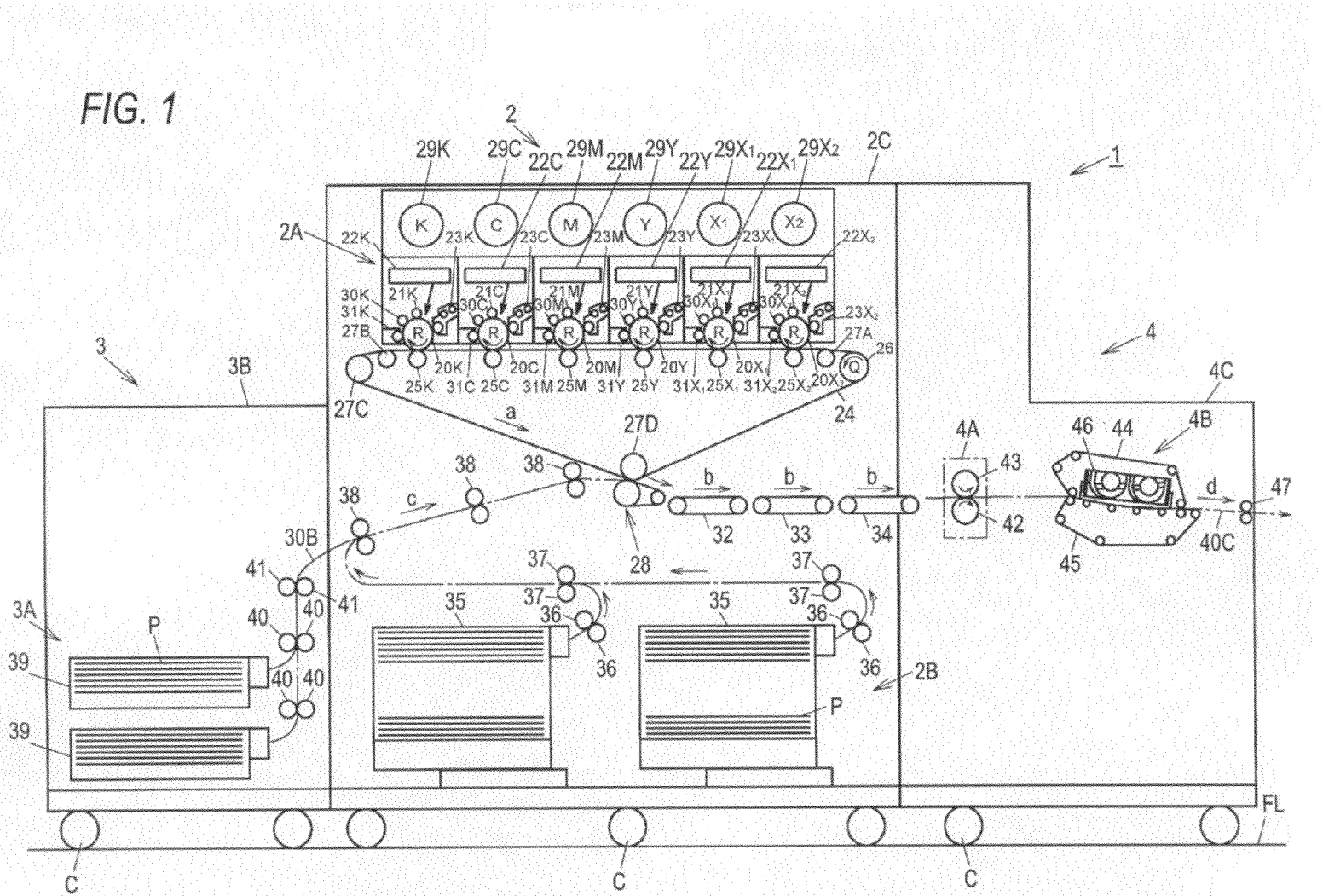
FIG. 1 is a front view showing a schematic structure of an image forming apparatus according to a first exemplary embodiment of the invention.
Figure 2:
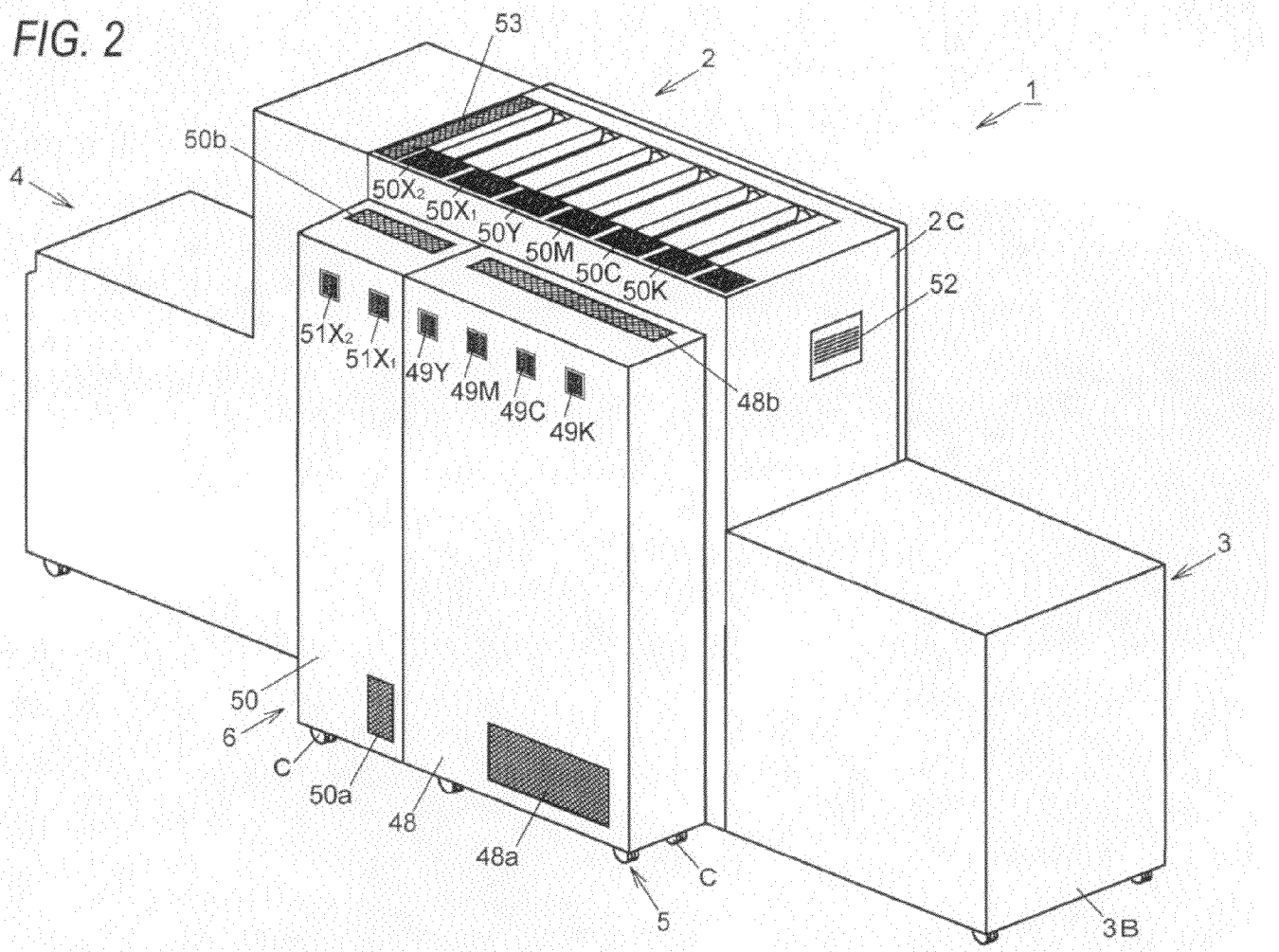
FIG. 2 is a perspective view showing an appearance of a back face portion in the image forming apparatus according to the first exemplary embodiment of the invention.

FIG. 1 shows a schematic structure of an image forming apparatus according to a first exemplary embodiment of the invention. An image forming apparatus 1 is applied to a color printer, for example, which includes a body unit 2, a paper feeding unit 3, a fixing unit 4, and filter units 5 and 6 which will be described below (both of which are shown in FIG. 2 to be described below), and is disposed on a floor surface FL movably through casters C and C. The image forming apparatus 1 has such a structure as to carry out an image processing over image data transmitted from a host apparatus such as a personal computer by an image processing portion (not shown) and to perform a conversion into image data having respective colors of yellow (Y), magenta (M), cyan (C), black (K), $X_1$ and $X_2$, and to then form a color image on a paper P to be a recording medium based on the image data on the respective colors of Y, M, C, K, $X_1$ and $X_2$.

$X_1$ and $X_2$ are colors other than the Y, M, C and K colors, and a halftone or a special black color is used for them, for example. For the recording medium, it is also possible to use a resin sheet such as an OHP (overhead projector) sheet in addition to the paper P.

(Structure of Body Unit 2)

The body unit 2 has an image forming portion 2A for forming an image on the paper P, a paper feeding portion 2B for feeding the paper P to the image forming portion 2A, and a first housing 2C serving as an apparatus body for accommodating the paper feeding portion 2B and the image forming portion 2A therein, and is disposed between the paper feeding unit 3 and the fixing unit 4.

The image forming portion 2A includes photosensitive drums 20Y, 20M, 20C, 20K, 20$X_1$ and 20$X_2$ serving as image carriers which are constituted by plural of (six corresponding to the respective colors of Y, M, C, K, $X_1$ and $X_2$ in the exemplary embodiment) image forming portions for forming images having the respective colors of Y, M, C, K, $X_1$ and $X_2$ and on which toner images having the respective colors of Y, M, C, K, $X_1$ and $X_2$ are formed, chargers 21Y, 21M, 21C, 21K, 21$X_1$ and 21$X_2$ for charging the photosensitive drums 20Y to 20$X_2$, exposing units 22Y, 22M, 22C, 22K, 22$X_1$ and 22$X_2$ serving as exposing portions for exposing the photosensitive drums 20Y to 20$X_2$ charged by the chargers 21Y to 21$X_2$, and developing units 23Y, 23M, 23C, 23K, 23$X_1$ and 23$X_2$ serving as developing portions for developing electrostatic latent images on the photosensitive drums 20Y to 20$X_2$ which are formed by the exposing units 22Y to 22$X_2$ with toner images having the respective colors of Y, M, C, K, $X_1$ and $X_2$.

The photosensitive drums 20Y, 20M, 20C, 20K, 20$X_1$ and 20$X_2$ have photosensitive layers on surfaces respectively, and are disposed in the first housing 2C rotatably in a direction of an arrow R.

The chargers 21Y, 21M, 21C, 21K, 21$X_1$ and 21$X_2$ are disposed around the corresponding photosensitive drums 20Y, 20M, 20C, 20K, 20$X_1$ and 20$X_2$ respectively and are constituted to charge the photosensitive drums 20Y to 20$X_2$ before an exposure.

The exposing units 22Y, 22M, 22C, 22K, 22$X_1$ and 22$X_2$ are disposed above the corresponding photosensitive drums 20Y, 20M, 20C, 20K, 20$X_1$ and 20$X_2$ respectively. The exposing units 22Y to 22$X_2$ are constituted to irradiate, on the photosensitive drums 20Y to 20$X_2$, exposed lights modulated based on the image data on the respective colors of Y to $X_2$, thereby forming electrostatic latent images having the respective colors of Y to $X_2$.

The developing units 23Y, 23M, 23C, 23K, 23$X_1$ and 23$X_2$ are disposed around the corresponding photosensitive drums 20Y, 20M, 20C, 20K, 20$X_1$ and 20$X_2$ respectively.

Moreover, the image forming portion 2A includes an intermediate transfer belt 24 to come in contact with the surfaces of the photosensitive drums 20Y, 20M, 20C, 20K, 20$X_1$ and 20$X_2$, primary transfer devices 25Y, 25M, 25C, 25K, 25$X_1$ and 25$X_2$ for primarily transferring, onto the intermediate transfer belt 24, the toner images having the respective colors of Y, M, C, K, $X_1$ and $X_2$ which are formed on the surfaces of the photosensitive drums 20Y, 20M, 20C, 20K, 20$X_1$ and 20$X_2$ respectively, a driving roll 26 for driving the intermediate transfer belt 24, support rolls 27A to 27D for rotatably supporting the intermediate transfer belt 24 at a predetermined tension, and a secondary transfer device 28 for secondarily transferring, onto the paper P, the toner images transferred onto the intermediate transfer belt 24. The intermediate transfer belt 24, the primary transfer devices 25Y, 25M, 25C, 25K, 25$X_1$ and 25$X_2$ and the secondary transfer device 28 constitute a transfer portion for transferring, onto the paper P, the toner images formed on the surfaces of the photosensitive drums 20Y, 20M, 20C, 20K, 20$X_1$ and 20$X_2$.

Toner bottles 29Y, 29M, 29C, 29K, 29$X_1$ and 29$X_2$ serving as toner feeding portions for accommodating toners having the respective colors of Y, M, C, K, $X_1$ and $X_2$ are disposed above the image forming portion 2A. Consequently, the toners having the respective colors of Y to $X_2$ are fed from the toner bottles 29Y to 29$X_2$ to the developing units 23Y to 23$X_2$.

The intermediate transfer belt 24 is formed by a non-end belt and is disposed between the primary transfer devices 25Y, 25M, 25C, 25K, 25$X_1$ and 25$X_2$ and the photosensitive drums 20Y, 20M, 20C, 20K, 20$X_1$ and 20$X_2$, and is laid over the driving roll 26 and the support rolls 27A to 27D. The intermediate transfer belt 24 is constituted to be circulated and moved in a direction of an arrow "a" by means of the driving roll 26. Static eliminators 30Y, 30M, 30C, 30K, 30$X_1$ and 30$X_2$ and drum cleaning devices 31Y, 31M, 31C, 31K, 31$X_1$ and 31$X_2$ are disposed on a drum contact side of the intermediate transfer belt 24. The static eliminators 30Y, 30M, 30C, 30K, 30$X_1$ and 30$X_2$ carry out a static elimination for the photosensitive drums 20Y, 20M, 20C, 20K, 20$X_1$ and 20$X_2$. The drum cleaning devices 31Y, 31M, 31C, 31K, 31$X_1$ and 31$X_2$ serve as image carrier cleaning portions for removing the toners remaining on the photosensitive drums 20Y, 20M, 20C, 20K, 20$X_1$ and 20$X_2$ subjected to the primary transfer. The remaining toners removed by the drum cleaning devices 31Y to 31$X_2$ are collected into an outside of the first housing 2C through a toner collecting path (not shown).

The primary transfer devices 25Y, 25M, 25C, 25K, 25$X_1$ and 25$X_2$ are formed by primary transfer rolls for causing the intermediate transfer belt 24 to come in pressure contact with the surfaces of the corresponding photosensitive drums 20Y, 20M, 20C, 20K, 20$X_1$ and 20$X_2$ respectively, and are rotatably disposed on an inside of the intermediate transfer belt 24. The primary transfer devices 25Y to 25$X_2$ have such a structure as to primarily transfer the toner images on the photosensitive drums 20Y to 20$X_2$ onto the intermediate transfer belt 24.

The driving roll 26 is rotatably disposed on the inside of the intermediate transfer belt 24. The driving roll 26 has such a structure as to circulate and move the intermediate transfer belt 24 in the direction of the arrow "a" through a rotation in a direction of an arrow "Q".

The support rolls 27A to 27D are constituted by driven rolls and are rotatably disposed on the inside of the intermediate transfer belt 24 in the same manner as the driving roll 26. The support rolls 27A and 27B function as primary transfer surface forming rolls, the support roll 27C functions as a tension roll, and the support roll 27D functions as a backup roll of the secondary transfer device 28.

The secondary transfer device 28 is formed by a transfer belt device and is disposed on an outside of the intermediate transfer belt 24. The secondary transfer device 28 is constituted to secondarily transfer the toner image on the intermediate transfer belt 24 onto the paper P. Delivering units 32 to 34 are disposed in parallel in a delivering direction of the paper P at a paper delivering side of the secondary transfer device 28. The delivering units 32 and 33 function as delivering belt conveyors for delivering the paper P in the body unit 2 in a direction of an arrow "b", and furthermore, the delivering unit 34 functions as a delivering belt conveyor for delivering the paper P in the direction of the arrow "b" between the body unit 2 and the fixing unit 4.

The paper feeding portion 2B has paper stackers 35 and 35 for accommodating the paper P therein and a pair of sorting rolls 36 and 36 for sorting the papers P accommodated in the paper stackers 35 and 35 one by one, and is disposed below the image forming portion 2A. A pair of resist rolls 37 and 37 and delivering rolls 38 and 38 are disposed on a downstream side of the paper feeding portion 2B. The resist rolls 37 and 37 are driven synchronously with a timing of the image forming and the delivering rolls 38 and 38 serve to deliver the paper P in a direction of an arrow "c" from the resist rolls 37 and 37 toward the secondary transfer device 28. The details of the first housing 2C will be described below.

(Structure of Paper Feeding Unit 3)

The paper feeding unit 3 has a paper feeding portion 3A for feeding the paper P to the image forming portion 2A of the body unit 2 and a second housing 3B for accommodating the paper feeding portion 3A therein, and is disposed on one of sides of the body unit 2 (a left side in FIG. 1).

The paper feeding portion 3A has paper feeding trays 39 and 39 for stacking the paper P therein and a pair of sorting rolls 40 and 40 for sorting the papers P sent from the paper feeding trays 39 and 39 one by one. A pair of resist rolls 41 and 41 to be driven synchronously with the image formation timing is disposed on a downstream side of the paper feeding portion 3A.

The second housing 3B includes a delivering path 30B from the paper feeding portion 3A toward the body unit 2 and is disposed on the floor surface FL movably through the casters C and C.

(Structure of Fixing Unit 4)

The fixing unit 4 has a fixing portion 4A for fixing a toner image transferred onto the paper P through heating and melting, a cooling portion 4B for cooling the paper P fixed in the fixing portion 4A, and a third housing 4C for accommodating the cooling portion 4B and the fixing portion 4A therein, and is disposed on the other side of the body unit 2 (a right side in FIG. 1).

The fixing portion 4A has a heating roll 42 and a pressurizing roll 43 and is disposed between the delivering unit 34 and the cooling portion 4B.

The cooling portion 4B has delivering units 44 and 45 for delivering the paper in a direction of an arrow "d", and a cooling unit 46 for cooling the paper P delivered by means of the delivering units 44 and 45, and is disposed on a downstream side of the fixing portion 4A. Discharging rolls 47 and 47 for discharging the paper P in the fixing unit 4 to an outside of the fixing unit 4 are disposed on a downstream side of the cooling portion 4B.

The third housing 4C includes a delivering path 40C reaching the discharging rolls 47 and 47 from the delivering unit 34 through the fixing portion 4A and the cooling portion 4B, and is disposed on the floor surface FL movably through the casters C and C.

FIG. 2 shows a back face portion of the image forming apparatus 1.

The first housing 2C is provided with a sucking port 52 for sucking outside air into an inner part, a discharging port 53 for discharging the outside air sucked from the sucking port 52 to an outside after a cooling operation for each image forming portion in the image forming portion 2A, and discharging ports 50Y, 50M, 50C, 50K, 50$X_1$ and 50$X_2$ for discharging a heat generated in the inner part. The sucking port 52 is formed on a side surface at one of the sides in the first housing 2C (the paper feeding unit 3 side), and the discharging port 53 is formed on an upper surface at the other side in the first housing 2C (the fixing unit 4 side).

The filter unit 5 has a filter housing box 48 and is disposed on a back face side of the body unit 2.

The filter housing box 48 has sucking ports 48*a* and 49Y to 49K for sucking the outside air into an inner part, and a discharging port 48*b* for discharging inside air to an outside and is disposed on the floor surface FL movably through the casters C and C. The sucking ports 48*a* and 49Y to 49K are formed on a back face side of the filter housing box 48, and the discharging port 48*b* is formed on a top face side of the filter housing box 48.

The filter housing box 48 includes a cloud filter for capturing a toner cloud to be a discarding target generated by driving the image forming portion 2A (shown in FIG. 1) and an ozone filter for capturing and decomposing ozone ($O_3$) to be the discarding target generated by driving the image forming portion 2A (neither of which is shown). Moreover, the filter housing box 48 is provided with a discharging port (not shown) for discharging the inside air to the outside after a passage through the cloud filter and the ozone filter. The discharging port is formed on a bottom face side of the filter housing box 48.

On the other hand, the filter unit 6 has a filter housing box 50 and is disposed on a back face side of the body unit 2 in parallel with a side of the filter unit 5.

The filter housing box 50 has sucking ports 50*a*, 51$X_1$ and 51$X_2$ for sucking the outside air into the inner part and a discharging port 50*b* for discharging the inside air to the outside, and is disposed on the floor surface FL movably through the casters C and C. The sucking ports 50*a*, 51$X_1$ and 51$X_2$ are formed on a back face side of the filter housing box 50 and the discharging port 50*b* is formed on a top face side of the filter housing box 50.

The filter housing box 50 includes a cloud filter for capturing a toner cloud to be a discarding target generated by driving the image forming portion 2A (shown in FIG. 1) and an ozone filter for capturing and decomposing ozone ($O_3$) to be the discarding target generated by driving the image forming portion 2A (neither of which is shown). Moreover, the filter housing box 50 is provided with a discharging port (not shown) for discharging the inside air to the outside after a passage through the cloud filter and the ozone filter. The discharging port is formed on a bottom face side of the filter housing box 50.

Figure 3:
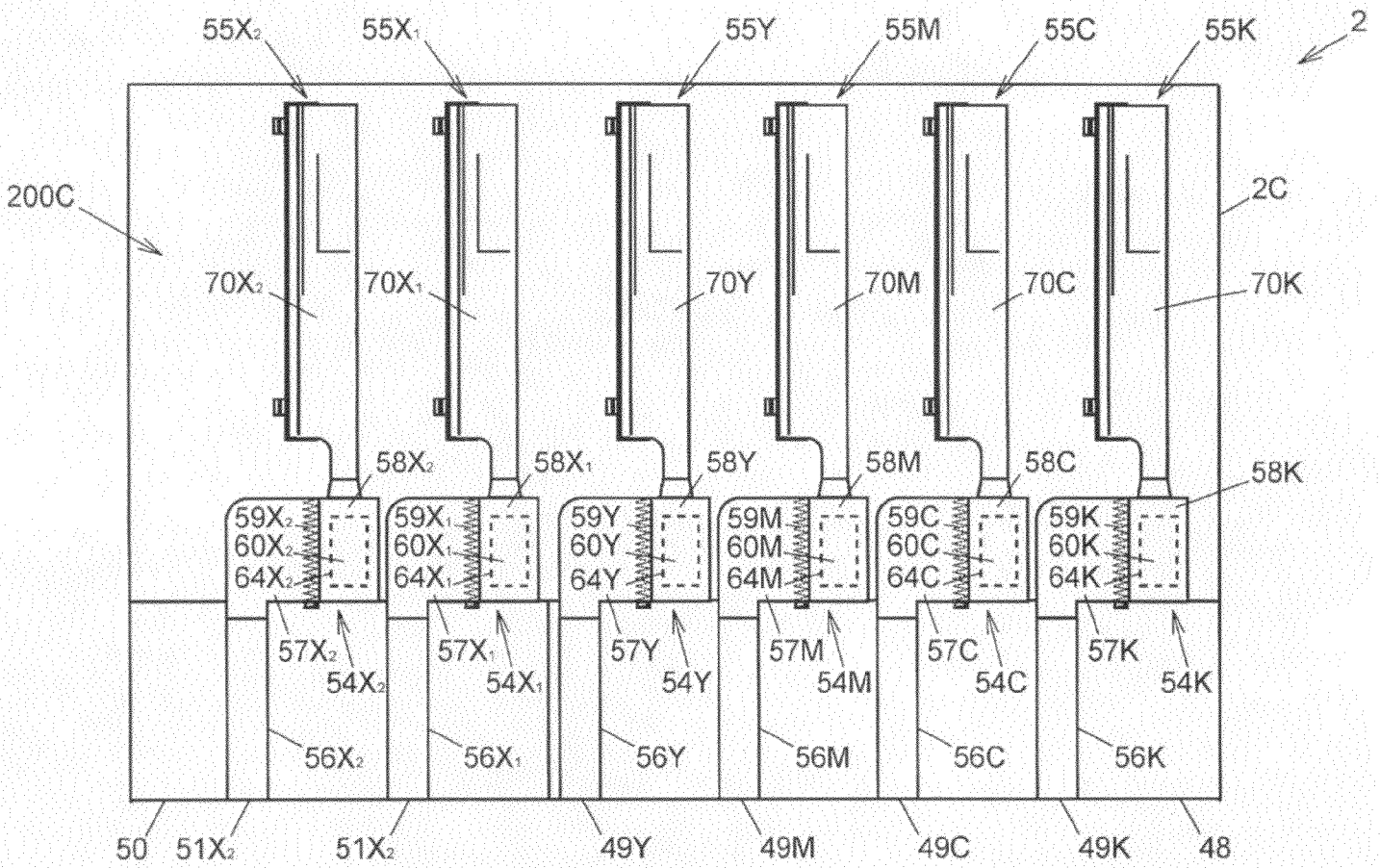
FIG. 3 is a plan view for explaining a whole air sucking path in the image forming apparatus according to the first exemplary embodiment of the invention.

FIG. 3 shows an inner part of the first housing and the filter housing box. The first housing 2C includes a housing space 200C and accommodates the image forming portion 2A and the paper feeding portion 2B (both of which are shown in FIG. 1) in the housing space 200C.

The housing space 200C of the first housing 2C accommodates dust removing devices 54Y, 54M, 54C, 54K, 54$X_1$ and 54$X_2$ serving as dust removing portions for removing dust fed together with the outside air toward the image forming portion 2A (shown in FIG. 1), and wire cleaning devices 55Y, 55M, 55C, 55K, 55$X_1$ and 55$X_2$ for cleaning a charging wire 71 and removing an unnecessary substance such as ozone or a toner cloud which stays around the charging wire 71.

The dust removing devices 54Y to 54$X_2$ are connected to the sucking ports 49Y to 49K, 51$X_1$ and 51$X_2$ through sucking ducts 56Y to 56$X_2$ and 57Y to 57$X_2$ respectively, and the wire cleaning devices 55Y to 55$X_2$ are connected to the dust removing devices 54Y to 54$X_2$ respectively.

(Dust Removing Device)

Figure 4A:
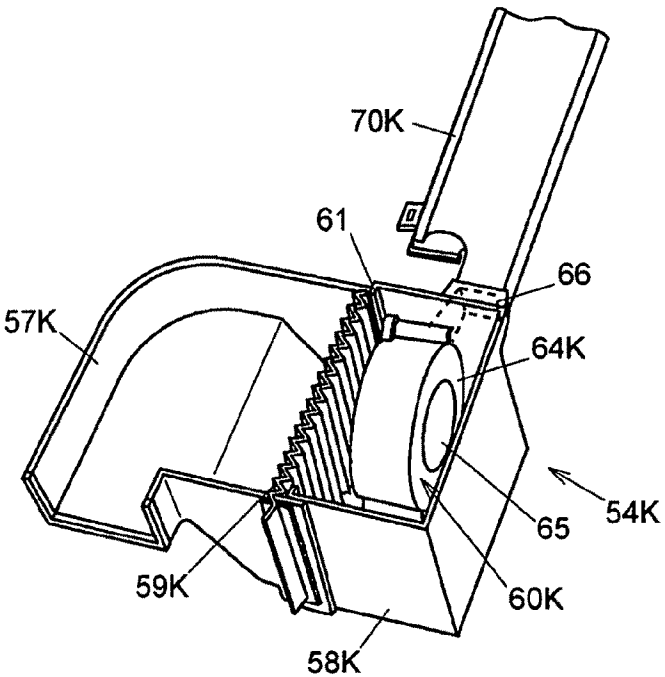
FIG. 4 is a view showing a dust removing device in the image forming apparatus according to the first exemplary embodiment of the invention, FIG. 4A being a perspective view showing an inner part and FIG. 4B being a perspective view showing an appearance.
Figure 4B:
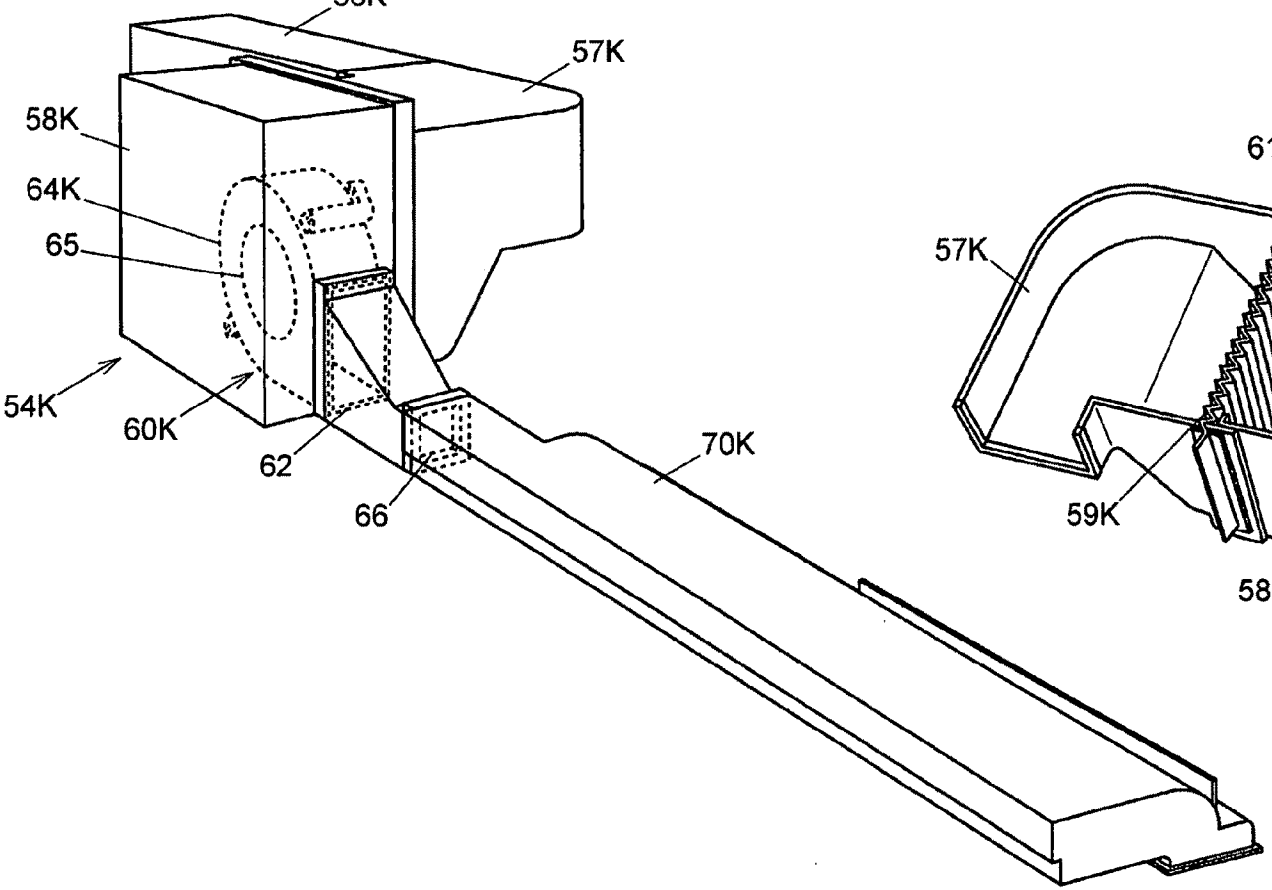
Figure 5:
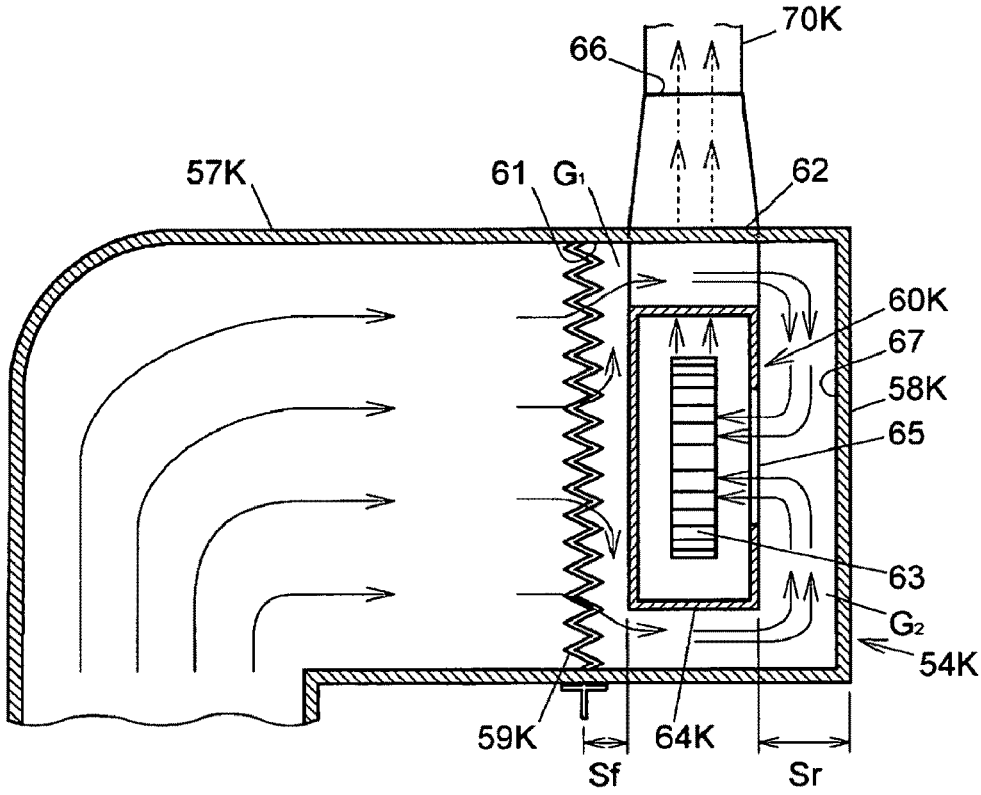
FIG. 5 is a sectional view for explaining the dust removing device of the image forming apparatus according to the first exemplary embodiment of the invention.

Next, the dust removing devices 54Y to 54$X_2$ will be described with reference to FIGS. 3, 4A, 4B and 5. FIGS. 4A and 4B show an inner part and an appearance of a housing case. FIG. 5 shows an inner part of the dust removing device. FIG. 4A shows a state in which upper parts of the sucking duct 57K and a housing case 58K are taken away.

As shown in FIG. 3, the dust removing devices 54Y to 54$X_2$ include housing cases 58Y to 58$X_2$ functioning as intermediate ducts, filters 59Y to 59$X_2$ for capturing dust, and air fans 60Y to 60$X_2$ for sending air to the chargers 21Y to 21$X_2$ (shown in FIG. 1) serving as blast target portions, and are disposed in the first housing 2C.

As shown in FIGS. 4A and 4B, the housing cases 58Y to 58$X_2$ (only the housing case 58K is shown) have a first opening portion 61 formed on an air sucking side and a second opening portion 62 formed on an air discharging side respectively, and are disposed between the sucking ducts 57Y to 57$X_2$ (only the sucking duct 57K is shown) and blast ducts 70Y to 70$X_2$ (only the blast duct 70K is shown). The first opening portion 61 is formed on the sucking duct 57Y to 57$X_2$ side and the second opening portion 62 is formed on the blast duct 70Y to 70$X_2$ side.

The filters 59Y to 59$X_2$ (only the filter 59K is shown) are provided in the housing cases 58Y to 58$X_2$ with a whole opening surface of the first opening portion 61 blocked with whole filter surfaces, respectively. The filters 59Y to 59$X_2$ have such a structure as to capture dust sucked together with the outside air from the first opening portion 61 to the housing case 58Y to 58$X_2$ side.

The air fans 60Y to 60$X_2$ (only the air fan 60K is shown) are constituted by a sirocco fan having an impeller 63 (shown in FIG. 5) to be rotated by a driving motor (not shown) and casings 64Y, 64M, 64C, 64K, 64$X_1$ and 64$X_2$ (only the casing 64K is shown) for accommodating the impeller 63 therein respectively and are disposed in the housing cases 58Y to 58$X_2$. The air fans 60Y to 60$X_2$ have such a structure as to send the outside air through the blast ducts 70Y to 70$X_2$ (only the blast duct 70K is shown) to the chargers 21Y to 21$X_2$ (shown in FIG. 1) to be cleaning target portions.

The casings 64Y to 64$X_2$ (only the casing 64K is shown) have an air inlet 65 for taking in the outside air passing through the filters 59Y to 59$X_2$ and an air outlet 66 for taking out an air flow generated by a rotation of the impeller 63 toward the blast duct 70Y to 70$X_2$ side respectively, and are connected to the blast ducts 70Y to 70$X_2$ with a part inserted through the second opening portion 62.

The air inlet 65 is formed on an opposite side to a side where the filters 59Y to 59$X_2$ (only the filter 59K is shown) are disposed. Consequently, the whole surfaces of the filters 59Y to 59$X_2$ may be utilized as a filter effective area. As compared with the case in which the air inlet 65 is provided on the disposing side, clogging may be more greatly prevented from being caused in the filters 59Y to 59$X_2$.

When a dimension between the casings 64Y to 64$X_2$ (only the casing 64K is shown) and the filters 59Y to 59$X_2$ (only the filter 59K is shown) is represented by Sf and a dimension between the casings 64Y to 64$X_2$ and an internal surface 67 of the housing cases 58Y to 58$X_2$ (only the housing case 58K is shown) opposed to an opening surface of the air inlet 65 is represented by Sr as shown in FIG. 5, moreover, Sf and Sr may be set to satisfy $Sf<Sr$, preferably $Sr/Sf>1.1$, and more preferably $Sr/Sf>1.5$. As compared with the case in which Sf and Sr are set to satisfy $Sf \geqq Sr$, consequently, it is possible to more smoothly carry out a flow of the outside air from a space portion $G_1$ formed between the filters 59Y to 59$X_2$ and the casings 64Y to 64$X_2$ to a space $G_2$ formed between the casings 64Y to 64$X_2$ and the internal surface 67.

(Wire Cleaning Device)

Figure 6:
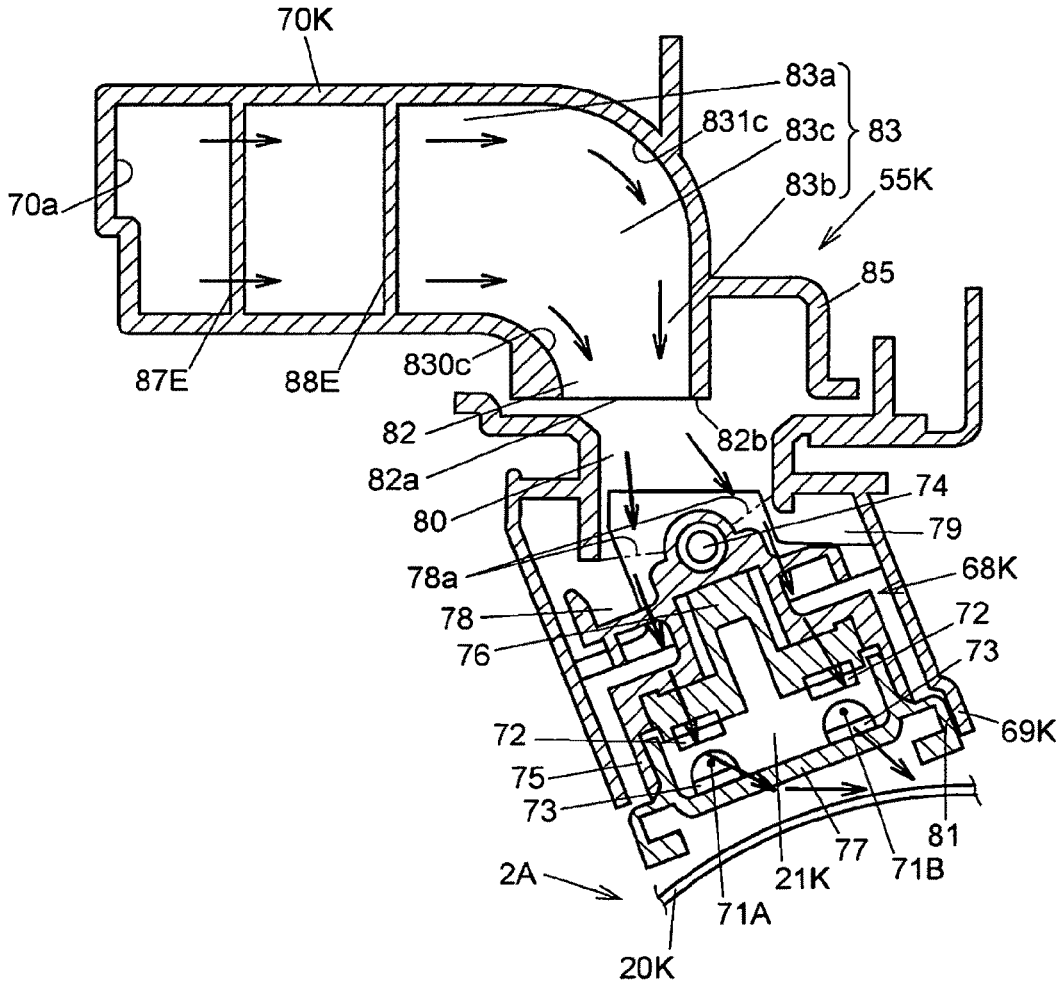
FIG. 6 is a sectional view for explaining a wire cleaning device of the image forming apparatus according to the first exemplary embodiment of the invention.
Figure 7A:
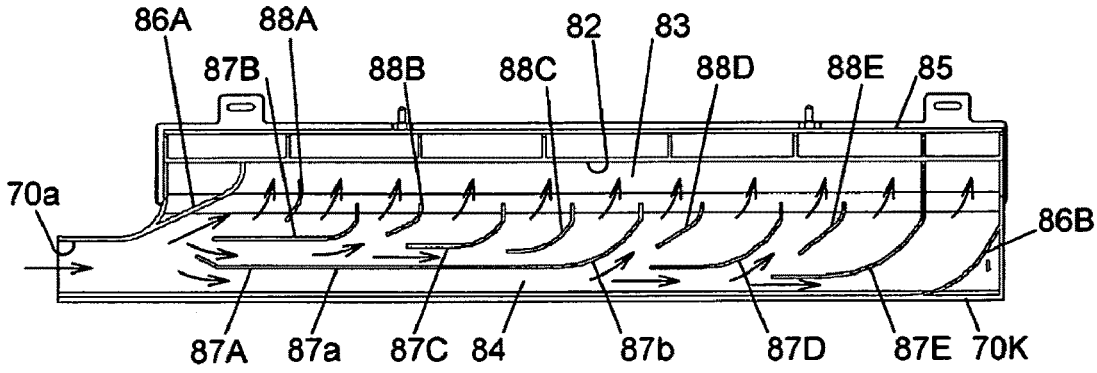
FIG. 7 is a view showing a blast duct of the image forming apparatus according to the first exemplary embodiment of the invention, FIG. 7A being a sectional view and FIG. 7B being a perspective view.
Figure 7B:
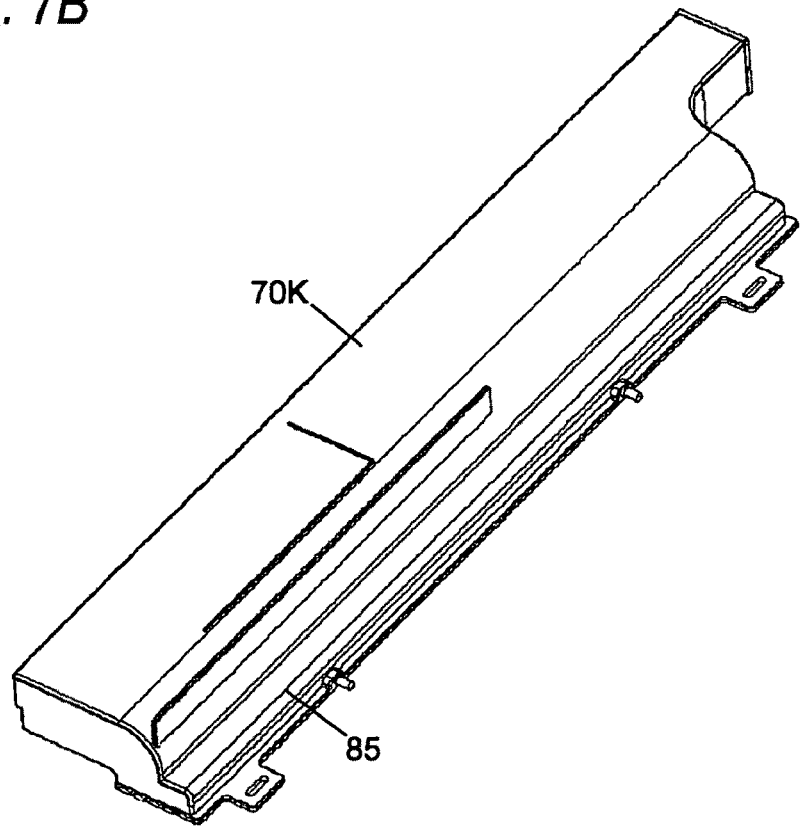
Figure 8A:
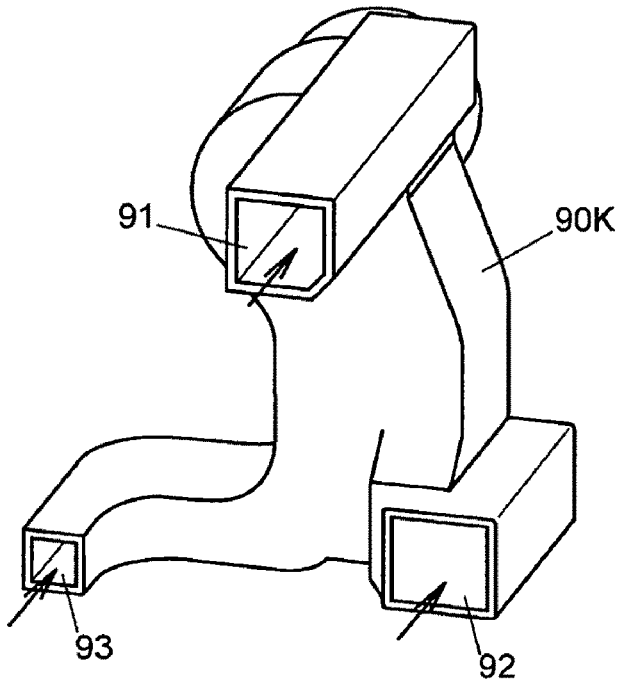
FIG. 8 is a view showing a discarding duct of the image forming apparatus according to the first exemplary embodiment of the invention, FIG. 8A being a perspective view showing a front face portion and FIG. 8B being a perspective view showing a back face portion.
Figure 8B:
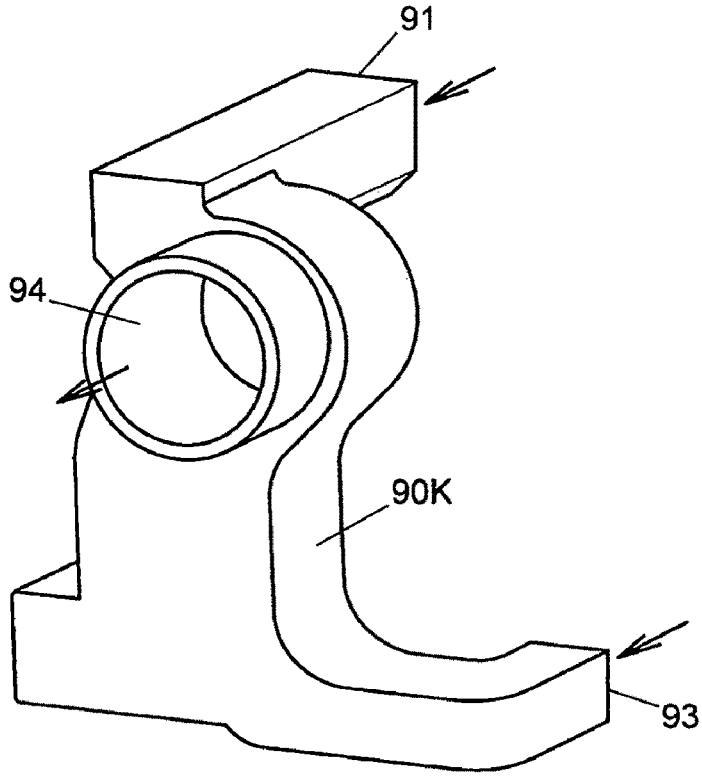
Figure 9:
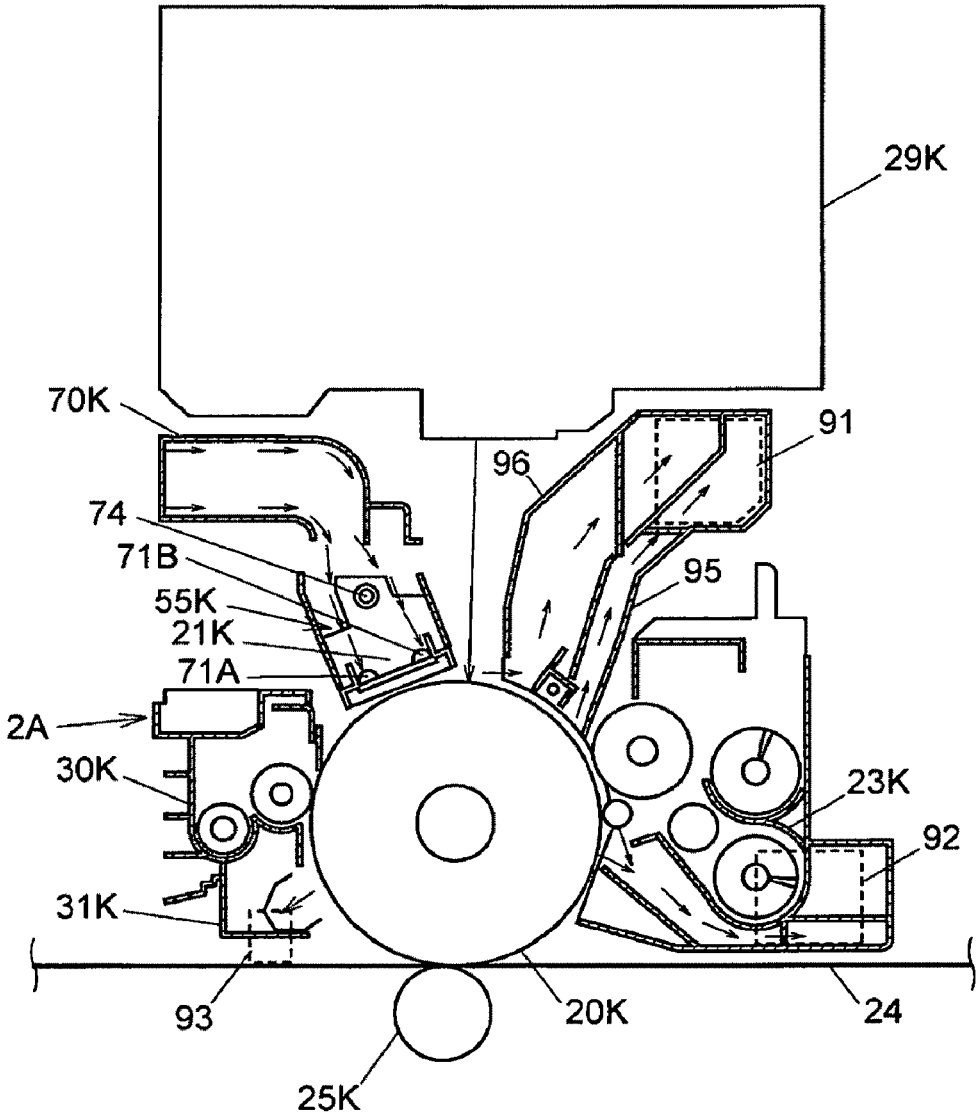
FIG. 9 is a sectional view for explaining an opening position of the discarding duct in the image forming apparatus according to the first exemplary embodiment of the invention.

Next, the wire cleaning devices 55Y to 55$X_2$ will be described with reference to FIGS. 6 to 9. FIG. 6 shows the wire cleaning device. FIGS. 7A and 7B show the blast duct. FIGS. 8A and 8B show the discarding duct. FIG. 9 shows an opening position of the discarding duct.

The wire cleaning devices 55Y to 55$X_2$ serve to move a wire cleaning member in an axial direction along charging wires to be a pair of charging members in contact of the wire cleaning member with the charging wires, thereby removing dust stuck to the charging wires, toner powder or a charged product such as ozone.

As shown in FIG. 6, the wire cleaning devices 55Y to 55$X_2$ (only the wire cleaning device 55K is shown) have wire cleaning mechanisms 68Y, 68M, 68C, 68K, 68$X_1$ and 68$X_2$ (only the wire cleaning mechanism 68K is shown), housing cases 69Y, 69M, 69C, 69K, 69$X_1$ and 69$X_2$ to be housing members (only the housing case 69K is shown) and the blast ducts 70Y, 70M, 70C, 70K, 70$X_1$ and 70$X_2$ to be blast passage forming members (only the blast duct 70K is shown), and are disposed around the photosensitive drums 20Y, 20M, 20C, 20K, 20$X_1$ and 20$X_2$ (only the photosensitive drum 20K is shown).

The wire cleaning mechanisms 68Y to 68$X_2$ (only the wire cleaning mechanism 68K is shown) have a pair of upper and lower wire cleaning members 72, 72, 73 and 73 for cleaning first and second charging wires 71A and 71B disposed in first and second positions and serving to charge the surfaces of the photosensitive drums 20Y to 20$X_2$ (only the photosensitive drum 20K is shown) and a lead screw 74 to be a driving member for driving the pair of upper and lower wire cleaning members 72, 72, 73 and 73, and are accommodated in the housing cases 69Y to 69$X_2$ (only the housing case 69K is shown) together with the first and second charging wires 71A and 71B.

The wire cleaning members 72 and 72 on an upper side are disposed on a moving member 75 in the housing cases 69Y to 69$X_2$ (only the housing case 69K is shown) rockably through a rocking member 76. The wire cleaning members 72 and 72 on the upper side have such a structure that they come in contact with the first and second charging wires 71A and 71B through a rocking motion of the rocking member 76 in wire cleaning after a movement of the moving member 75 from a home position and are separated from the first and second charging wires 71A and 71B by a rocking return of the rocking member 76 when the moving member 75 is placed in the home position (in wire non-cleaning).

The wire cleaning members 73 and 73 on a lower side are disposed on the moving member 75 through a support member 77 under the wire cleaning members 72 and 72 on the upper side. The wire cleaning members 73 and 73 on the lower side are constituted to always come in contact with the first and second charging wires 71A and 71B.

The lead screw 74 is a male screw disposed in parallel with a longitudinal direction of the first and second charging wires 71A and 71B and is disposed rotatably in the housing cases 69Y to 69$X_2$ (only the housing case 69K is shown), respectively. The lead screw 74 has such a structure as to be rotated by means of a driving motor (not shown) and to reciprocate the moving member 75 attached to the lead screw 74 with a female screw along the first and second charging wires 71A and 71B, thereby driving the wire cleaning members 72 and 72 on the upper side and the wire cleaning members 73 and 73 on the lower side.

The housing cases 69Y to 69$X_2$ (only the housing case 69K is shown) have first and second branch paths 78 and 79 which are branched at a downstream side of the lead screw 74 which is set to be a branch portion, an air inlet 80 formed on an upstream side of the lead screw 74, and an air outlet 81 for carrying out a circulation to the air inlet 80 through the branch paths 78 and 79, and are disposed in the vicinity of the photosensitive drums 20Y to 20$X_2$ (only the photosensitive drum 20K is shown), respectively.

The blast ducts 70Y to 70$X_2$ (only the blast duct 70K is shown) have an air inlet 70*a* through which air flows from the air fans 60Y to 60$X_2$, a blast port 82 provided in almost parallel with an axial direction of the first and second charging wires 71A and 71B (for example, a range of ±20° with respect to a parallel direction) and serving to send outside air to the first and second charging wires 71A and 71B through the first and second branch paths 78 and 79, and a curved path 83 serving as a circulating path for converting a direction of a flow of the outside air from an air flow-in side into an air flow-out side and carrying out a circulation to the blast port 82, and are disposed on an upstream side of the housing cases 69Y to 69$X_2$ (only the housing case 69K is shown).

The blast port 82 has an opening surface 82*a* disposed eccentrically toward the first branch path 78 side which is close to the air flow-in side of the curved path 83 in the first and second branch paths 78 and 79. In other words, either of the pair of opening surfaces 78*a* and 78*a* in the housing cases 69Y to 69$X_2$ which is placed on the air flow-in side of the curved path 83 is disposed opposite to the opening surface 82*a* of the blast ducts 70Y to 70$X_2$. Moreover, the blast port 82 has an outer end face 82*b* forming a part of an opening end face thereof which is disposed almost just above the lead screw 74. Consequently, the outside air sent from the blast port 82 to the downstream side is branched to have a higher wind speed on the first charging wire 71A side than that on the second charging wire 71B side through the lead screw 74 and flows in the axial direction of the first and second branch paths 78 and 79 in a state of a small speed unevenness, and is then sent to the charging wires 71A and 71B through the branch paths 78 and 79 so that an unnecessary substance staying around the charging wires 71A and 71B is discharged to the outside through introducing ducts 95 and 96. The opening surface 78*a* on the air flow-in side of the curved path 83 and the other opening surface 78*a* in the housing cases 69Y to 69$X_2$ may be partially disposed opposite to the opening surface 82*a* of the blast ducts 70Y to 70$X_2$. It is preferable that the air should be sent to the first and second branch paths 78 and 79 almost perpendicularly (for example, a range of ±20° with respect to a perpendicular direction) to the first and second charging wires 71A and 71B.

The curved path 83 includes passages 83*a* and 83*b* having axes which are orthogonal to each other and a passage 83*c* provided between both of the passages 83*a* and 83*b*, and is disposed on the air flow-out side of the blast ducts 70Y to 70$X_2$. The passage 83*a* is opened to a straight path 84 (shown in FIG. 7A) and the passage 83*b* is opened to the outside through the blast port 82. The passage 83*c* is formed by a curved surface in which two inner and outer road surfaces 830*c* and 831*c* have different curvatures from each other.

As shown in FIG. 7A, moreover, the blast ducts 70Y to 70$X_2$ (only the blast duct 70K is shown) have the straight path (guiding passage) 84 for carrying out a circulation to the passage 83*a* of the curved path 83 respectively, and are connected to the air inlet 66 (shown in FIG. 5) of the casings 64Y to 64$X_2$ (shown in FIG. 3) in the air fans 60Y to 60$X_2$ (shown in FIG. 3). A reinforcing portion 85 protruded from the curved path 83 toward an opposite side to the straight path 84 is provided integrally with the blast ducts 70Y to 70$X_2$ as shown in FIG. 7B.

The straight path 84 is disposed on the air flow-in side of the blast ducts 70Y to 70$X_2$ (only the blast duct 70K is shown) and is connected to the air outlet 66 of the casings 64Y to 64$X_2$ (shown in FIG. 3) in the air fans 60Y to 60$X_2$ (shown in FIG. 3). A plurality of guiding members 86, 87 and 88 for guiding the outside air to the blast port 82 is disposed in the straight path 84 in parallel with the axial direction of the pair of left and right first and second charging wires 71A and 71B (shown in FIG. 6). In this case, the guiding members 86, 87 and 88 are preferably formed in such a manner that an air flow obtained by the outside air from the straight path 84 to the curved path 83 has no wind speed unevenness in the axial direction of the first and second charging wires 71A and 71B.

In the exemplary embodiment, the straight path 84 is provided with a guiding member (a first guiding member) 86A and a guiding member 86B which are disposed on both ends respectively, a guiding member (a second guiding member) 87A, a guiding member (a third guiding member) 87B, and guiding members 87C to 87E which are disposed on an inside of the guiding members 86A and 86B and are constituted by a straight portion 87*a* that is almost parallel with the axial direction of the charging wires 71A and 71B (for example, a range of ±20° with respect to a parallel direction) and a curved portion 87*b* taking a curved shape from the straight portion 87*a* toward the curved path 83, and guiding members 88A to 88E disposed among the guiding member (the second guiding member) 87A, the guiding member (the third guiding member) 87B and the guiding members 87C to 87E and taking curved shapes.

By the structures of the guiding members 86, 87 and 88, the air flow obtained by the outside air is branched into three parts by means of the guiding members 87A and 87B on an inlet side, and a branch flow on one of end sides is guided to the curved path 83 through the guiding member 88A, a central branch flow is guided to the curved path 83 by means of the guiding members 87C, 88B and 88C, and a branch flow on the other end side is guided to the curved path 83 by means of the guiding members 87D, 87E, 88D and 88E. Therefore, the outside air may be sent from the straight path 84 to the curved path 83 in a state of a small speed unevenness in the axial direction of the charging wires 71A and 71B.

Discarding ducts 90Y, 90M, 90C, 90K, 90$X_1$ and 90$X_2$ (only the discarding duct 90K is shown in FIGS. 8A and 8B) serving as discharging members illustrated in FIG. 8 are disposed in the vicinity of the wire cleaning devices 55Y to 55$X_2$ (only the wire cleaning device 55K is shown in FIG. 6).

The discarding ducts 90Y to 90$X_2$ have first to fourth opening portions 91 to 94 shown in FIGS. 8A and 8B, and the first to third opening portions 91 to 93 communicate with the fourth opening portion 94, respectively. The fourth opening portion 94 is connected to a discarding tube having an accordion pipe (not shown) in the filter housing boxes 5 and 6 (shown in FIG. 2). An air fan for causing inside air to flow to the outside is provided in the discarding tube. The discarding targets such as a toner cloud and ozone which are generated in the image forming portion 2A (shown in FIG. 6) are captured by means of a cloud filter and an ozone filter when the inside air is to be discharged to the outside by the air fan through the discarding ducts 90Y to 90$X_2$ and the discarding tube having the accordion pipe.

As shown in FIG. 9, the first opening portion 91 is formed on the photosensitive drum 20Y, 20M, 20C, 20K, 20$X_1$ and 20$X_2$ (only the photosensitive drum 20K is shown) side through the cloud introducing duct 95 and the ozone introducing duct 96 to be an air discharging passage forming member, the second opening portion 92 is formed on the developing unit 23Y, 23M, 23C, 23K, 23$X_1$ and 23$X_2$ (only the developing unit 23K is shown) side, and the third opening portion 93 is formed on the drum cleaning device 31Y, 31M, 31C, 31K, 31$X_1$ and 31$X_2$ (only the drum cleaning device 31K is shown) side. The ozone introducing duct 96 is provided closer to a second position side on which the second charging wire 71B is disposed than a first position in which the first charging wire 71A is disposed. Amounts of air sent to the first to third opening portions 91 to 93 are set to be flow rates having a distribution ratio of approximately 7:5:1, for example. In other words, if the amount of air sent to the third opening portion 93 is set to be "1", the amount of air sent to the first opening portion 91 is set to be "7" and the amount of air sent to the second opening portion 92 is set to be "5".

<Structure of Air Inlet Side of Blast Duct>

Figure 10:
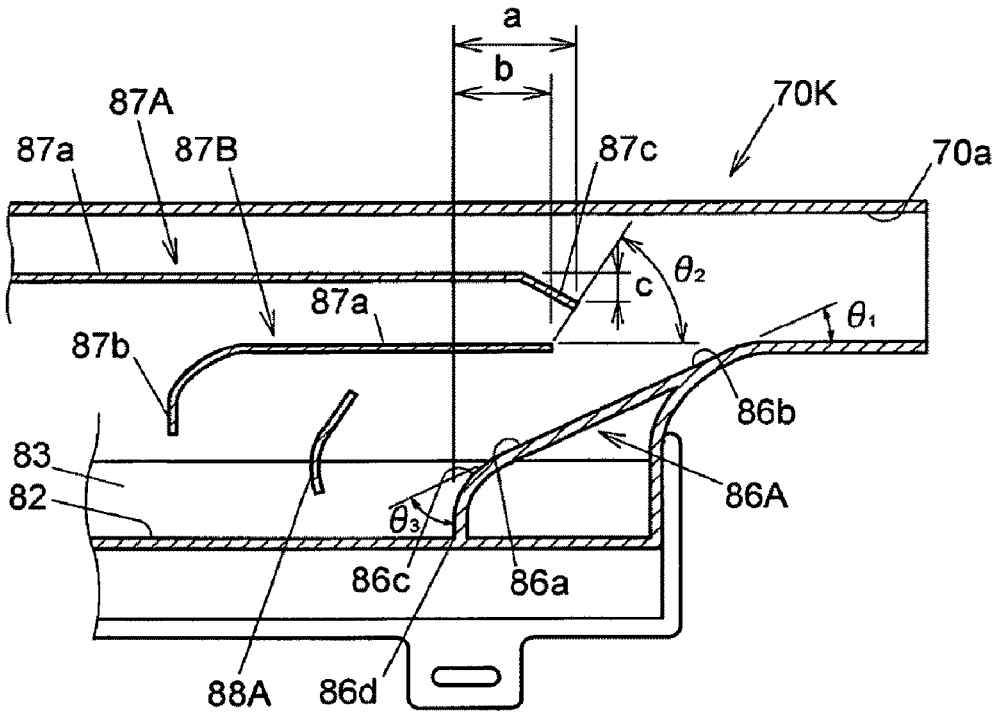
FIG. 10 is a view showing the details of an air inlet side of the blast duct.

Next, description will be given to a structure of the air inlet side of the blast ducts 70Y to 70$X_2$. FIG. 10 is a view showing the details of the air inlet side of the blast duct.

As shown in FIG. 10, the guiding member 86A which is the closest to the air inlet 70*a* side of the blast ducts 70Y to 70$X_2$ (only the blast duct 70K is shown) is constituted by a straight portion 86*a*, and a first curved portion 86*b* and a second curved portion 86*c* which are connected to both end sides of the straight portion 86*a* respectively. The straight portion 86*a* of the guiding member 86A is tilted at an angle of $\theta_1$ with respect to an air inflow direction.

Two guiding members 87A and 87B for branching the outside air flowing into the air inlet 70*a* into three parts are protruded by distances "a" and "b" (a>b) from an end 86*d* of the second curved portion 86*c* on the blast port 82 side toward the air inlet 70*a* side, respectively. The guiding member 87A which is more distant from the blast port 82 has a tilted portion 87*c* provided on the air inlet 70*a* side of the straight portion 87*a*. The tilted portion 87*c* is tilted to the blast port 82 side by a distance "c". A line connecting an end of the tilted portion 87*c* of the guiding member 87A and an end on the air inlet 70*a* side in the guiding member 87B is tilted at an angle of $\theta_2$ ($\theta_2>\theta_1$) with respect to the air inflow direction. Consequently, a great turbulent flow occurs in air flows $f_2$ and $f_{32}$ with difficulty. It is preferable that the dimension "a" should be 30 to 50 mm, the dimension "b" should be 20 to 40 mm, and the dimension "c" should be 1 to 6 mm. $\theta_1$ is preferably 15 to 35° and is more preferably 20 to 30°. $\theta_2$ is preferably 40 to 60° and is more preferably 45 to 55°. The tilted portion 87*c* of the guiding member 87A may be straight or gently curved.

<Flow of Air on Air Inlet Side of Blast Duct>

Figure 11A:
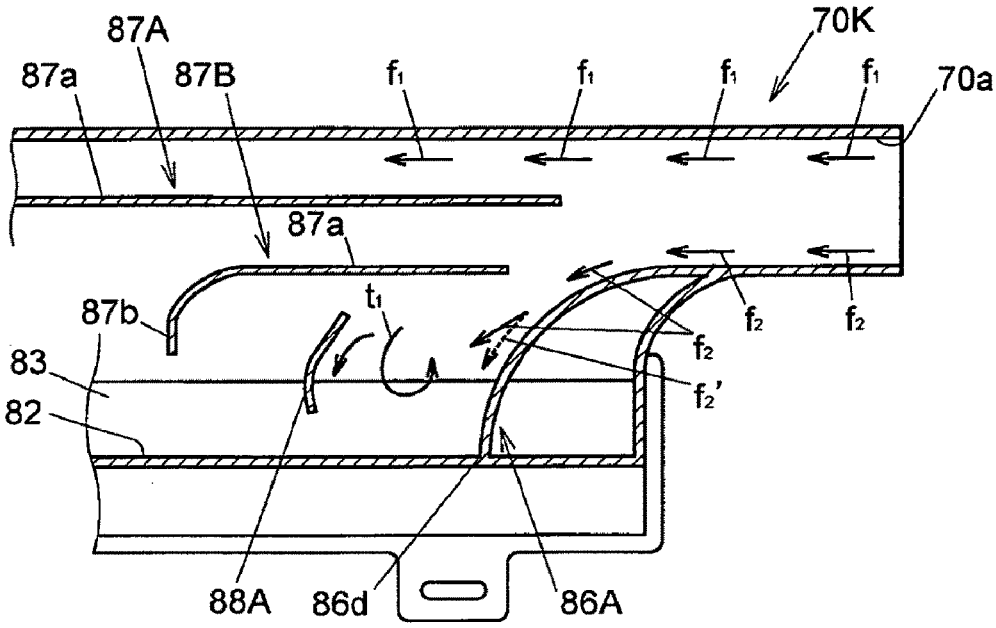
FIG. 11A is a view for explaining an air flow on the air inlet side of the blast duct and FIG. 11B is a view for explaining an air flow on an air inlet side of a blast duct according to a comparative example.
Figure 11B:
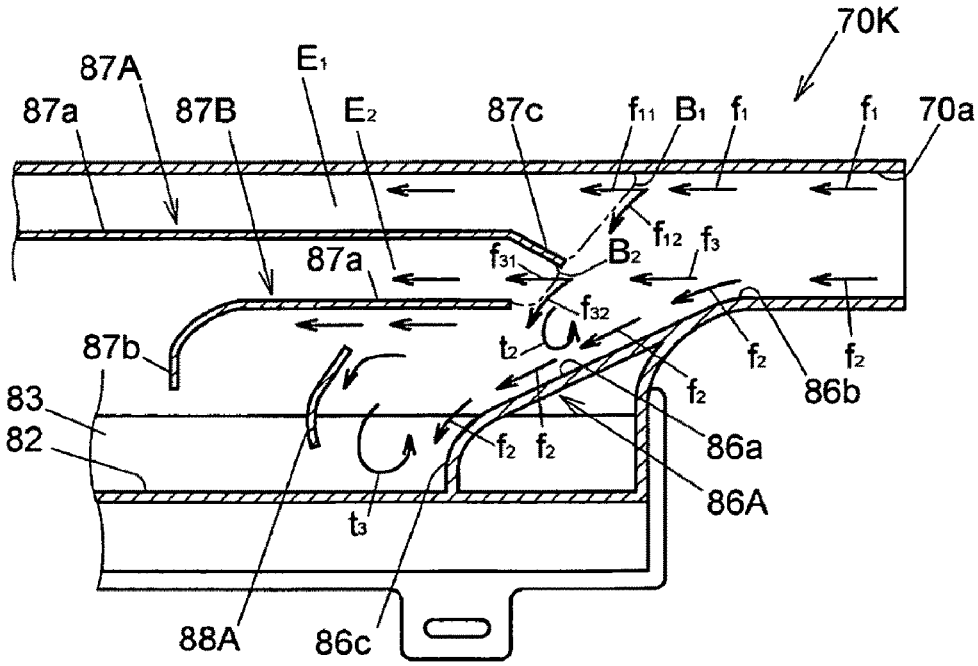

Next, description will be given to an air flow on the air inlet side of the blast ducts 70Y to 70$X_2$. FIG. 11A is a view for explaining an air flow on an air inlet side of a blast duct according to a comparative example and FIG. 11B is a view for explaining the air flow on the air inlet side of the blast duct.

(Blast Duct According to Comparative Example)

In the blast duct 70K according to the comparative example, the guiding member 86A on the air inlet 70*a* side is constituted by only a curved portion. Ends on the air inlet 70*a* side of the guiding members 87A and 87B are positioned on an opposite side to the air inlet 70*a* as compared with the end 86*d* on the blast port 82 side in the guiding member 86A.

In the comparative example, when outside air flows into the air inlet 70*a*, there is a tendency that an air flow $f_1$ on a distant side from the blast port 82 advances between the guiding member 87A and an external wall and the air flow $f_2$ on a close side to the blast port 82 advances to the blast port 82 along the guiding member 86A. However, a part of an air flow $f_2'$ in FIG. 11A separates from the guiding member 86A. When the air flow is to advance to the blast port 82, moreover, a great turbulent flow $t_1$ is generated. A wind speed is reduced due to the separation of the air flow $f_2'$ and the generation of the turbulent flow $t_1$ so that an air amount (wind speed) unevenness in the axial direction of the charging wires 71A and 71B is caused. Even if a guiding member is disposed in a position in which the turbulent flow $t_1$ is generated in order to prevent the generation of the turbulent flow $t_1$, moreover, there is a possibility that a pressure loss might occur, resulting in a reduction in the wind speed.

(Blast Duct According to First Embodiment)

In the blast ducts 70Y to 70$X_2$ according to the exemplary embodiment (only the blast duct 70K is shown), as illustrated in FIG. 11B, when the outside air flows into the air inlet 70*a*, a partial air flow $f_{11}$ of the air flow $f_1$ on a distant side from the blast port 82 exactly advances, the other air flow $f_{12}$ is curved toward the blast port 82 along a boundary $B_1$ of a high pressure region $E_1$ formed between the guiding member 87A and the external wall, and the air flow $f_2$ on a close side to the blast port 82 advances to the blast port 82 without causing a separation along the guiding member 86A due to a pressure difference in the boundary $B_1$.

A partial air flow $f_{31}$ of an air flow $f_3$ which tends to advance between the guiding members 87A and 87B advances exactly and the other air flow $f_{32}$ is curved toward the blast port 82 along a boundary $B_2$ of a high pressure region $E_2$ formed between the guiding members 87A and 87B due to a pressure difference in the boundary $B_2$. The high pressure regions $E_1$ and $E_2$ are generated because of the advance of the air flow from a wide passage to a narrow passage at the air inlet 70*a* side, and a pressure is gradually raised in accordance with the advance to an inner part. For this reason, amounts of the air flows $f_{11}$ and $f_{31}$ advancing straight are comparatively larger than those of the curved air flows $f_{12}$ and $f_{32}$ so that the wind speed on the air inlet 70*a* side of the blast port 82 is inhibited from being increased if a pulsation of the wind speed occurs on a blast source side so that the wind speed is increased due to the air fans 60Y to 60$X_2$ or a shape of the duct on a side where the outside air is fed to the blast duct 70K, and the amounts of the curved air flows $f_{12}$ and $f_{32}$ are comparatively larger than those of the air flows $f_{11}$ and $f_{31}$ advancing straight so that the wind speed on the air inlet 70*a* side of the blast port 82 is inhibited from being reduced if the wind speed on the blast source side is reduced.

When a smaller one of angles formed by two tangential lines in the first curved portion 86*b* is represented by $\theta_1$ and a smaller one of angles formed by two tangential lines in the second curved portion 86*c* is represented by $\theta_3$, moreover, a relationship of $\theta_1<\theta_3$ is satisfied so that a turbulent flow $t_2$ may be inhibited from being generated in the vicinity in which the air flow $f_3$ collides with the boundary $B_2$ and a place in which the turbulent flow is generated (a place in which a separation is caused) may be controlled more greatly as compared with the turbulent flow $t_1$ generated in the comparative example, and the wind speed on the air inlet 70*a* side of the blast port 82 may be inhibited from being reduced.

(Operation of Image Forming Apparatus 1)

Next, an operation of the image forming apparatus 1 according to the first exemplary embodiment will be described with reference to FIGS. 1 to 3, 5 and 6.

As shown in FIG. 1, in the case in which the papers P are fed from the paper feeding portion 2B of the body unit 2, the papers P stacked in the paper stackers 35 and 35 are separated one by one through a pickup roll (not shown) and are sent from the sorting rolls 36 and 36 to the resist rolls 37 and 37 which are being stopped.

Subsequently, a tip of the paper P is caused to collide with the resist rolls 37 and 37, and an oblique transmission of the paper P is modified and the tip of the paper P is aligned to cause the paper P to stand by.

In the case in which the papers P are fed from the paper feeding portion 3A of the paper feeding unit 3, the papers P stacked in the paper feeding trays 39 and 39 are separated one by one through a pickup roll (not shown) and are sent from the sorting rolls 40 and 40 to the resist rolls 41 and 41 which are being stopped.

Then, the tip of the paper P is caused to collide with the resist rolls 41 and 41, and an oblique transmission of the paper P is modified and the tip of the paper P is aligned to cause the paper P to stand by.

Thereafter, the resist rolls 37 and 37 or the resist rolls 41 and 41 are rotated to feed the paper P to the secondary transfer device 28 synchronously with the image formation timing in the image forming portion 2A and toner images formed on the photosensitive drums 20Y, 20M, 20C, 20K, 20$X_1$ and 20$X_2$ are primarily transferred onto the intermediate transfer belt 24 through the primary transfer devices 25Y, 25M, 25C, 25K, 25$X_1$ and 25$X_2$, and a toner image is thereafter transferred secondarily onto the paper P fed to a position of the support roll 27D in the secondary transfer device 28.

In the image forming apparatus 1, subsequently, the toner image is fixed onto the paper P by the fixing portion 4A of the fixing unit 4 and the paper P is then cooled by the cooling portion 4B and is discharged to the outside of the fixing unit 4 by means of the discharging rolls 47 and 47.

In this case, as shown in FIG. 2, air on the outside of the filter housing boxes 48 and 50 is sucked from the sucking ports 49Y, 49M, 49C, 49K, 51$X_1$ and 51$X_2$ into the sucking ducts 56Y, 56M, 56C, 56K, 56$X_1$ and 56$X_2$ (shown in FIG. 3) in the filter housing boxes 48 and 50.

As shown in FIG. 3, the outside air sucked into the sucking ducts 56Y to 56$X_2$ flows into the sucking ducts 57Y, 57M, 57C, 57K, 57$X_1$ and 57$X_2$ and then passes through the filters 59Y, 59M, 59C, 59K, 59$X_1$ and 59$X_2$ (only the filter 59K is shown in FIG. 5), and flows into the housing cases 58Y, 58M, 58C, 58K, 58$X_1$ and 58$X_2$.

In this case, when dust is sucked into the sucking ducts 56Y to 56$X_2$ together with the outside air, it is captured by means of the filters 59Y to 59$X_2$ (only the filter 59K is shown) with the whole surfaces thereof set to be a filter effective area.

As shown in FIG. 5, the outside air flowing into the housing cases 58Y to 58$X_2$ is guided from the space $G_1$ to the space $G_2$ by driving the air fans 60Y, 60M, 60C, 60K, 60$X_1$ and 60$X_2$ (only the air fan 60K is shown) and is taken from the air inlet 65 to the casings 64Y, 64M, 64C, 64K, 64$X_1$ and 64$X_2$ (only the casing 64K is shown).

The outside air taken into the casings 64Y to 64$X_2$ flows from the air outlet 66 to the outside of the casings 64Y to 64$X_2$ by an action of a centrifugal force generated by a rotation of the impeller 63, and flows from the air inlet 70*a* into the blast ducts 70Y, 70M, 70C, 70K, 70$X_1$ and 70$X_2$ (only the blast duct 70K is shown).

As shown in FIG. 6, the outside air flowing into the blast ducts 70Y to 70$X_2$ is guided from the air flow-in side to the air flow-out side in the straight path 84 (shown in FIG. 7A) through the guiding members 86A, 86B, 87A to 87E, and 88A to 88E (shown in FIG. 7A), and furthermore, flows in the curved path 83 from the blast port 82 to the outside of the blast ducts 70Y to 70$X_2$, and then flows into the housing cases 69Y, 69M, 69C, 69K, 69$X_1$ and 69$X_2$ (only the housing case 69K is shown) through the air inlet 80.

The outside air flowing into the housing cases 69Y to 69$X_2$ is branched in such a manner that a higher wind speed is obtained on the first charging wire 71A side than the second charging wire 71B side by means of the lead screw 74, and flows in a state in which a speed unevenness is small in the axial direction of the first and second branch paths 78 and 79 and then flows in the first and second branch paths 78 and 79, and is sent to the first and second charging wires 71A and 71B respectively. The outside air sent to the first charging wire 71A is further sent to the second charging wire 71B. The air is sent to the charging wires 71A and 71B so that an unnecessary substance such as ozone or a toner cloud which stays around the charging wires 71A and 71B is discharged to the outside together with the outside air via the cloud introducing duct 95 and the ozone introducing duct 96.

[Second Embodiment]

Figure 12:
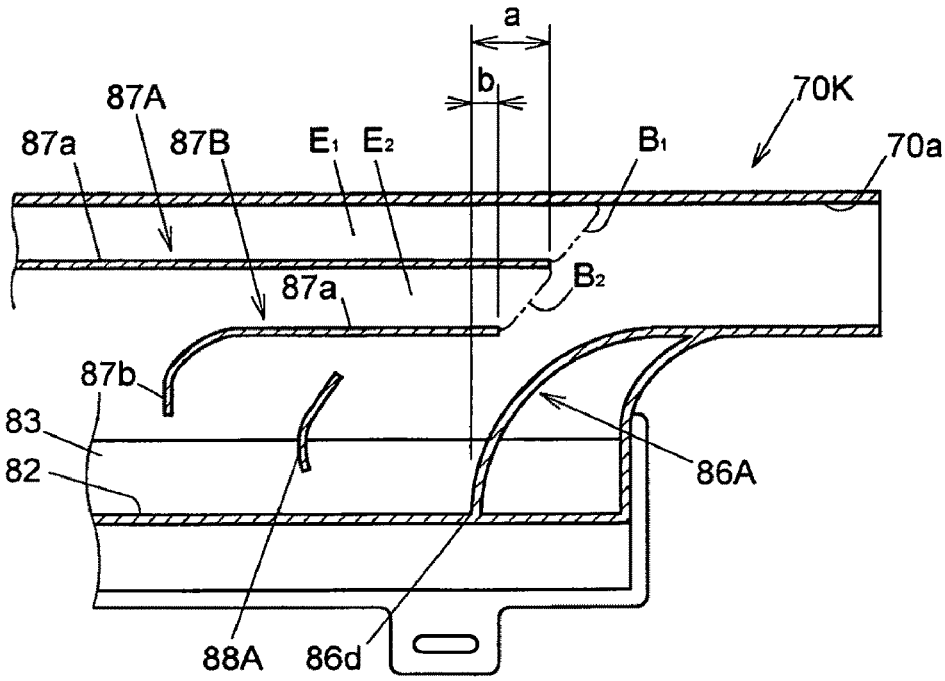
FIG. 12 is a view showing the details of an air inlet side of a blast duct in an image forming apparatus according to a second exemplary embodiment of the invention.

FIG. 12 is a view showing the details of an air inlet side of a blast duct in an image forming apparatus according to a second exemplary embodiment of the invention.

In blast ducts 70Y to 70$X_2$ according to the exemplary embodiment (only the blast duct 70K is shown), a guiding member 86A which is the closest to an air inlet 70*a* side is constituted by only a curved portion as shown in FIG. 11A. Ends on the air inlet 70*a* side in two guiding members 87A and 87B are protruded from an end 86*d* on a blast port 82 side in the guiding member 86A toward the air inlet 70*a* side by distances "a" and "b" respectively, and the guiding member 87A which is more distant from the blast port 82 does not have a tilted portion 87*c* provided on an end of a straight portion 87*a*.

Also in the exemplary embodiment, as described with reference to FIG. 11B, a reduction in a wind speed on the air inlet 70*a* side of the blast port 82 may be inhibited by an action of the boundary $B_1$ of the high pressure region $E_1$ formed between the guiding member 87A and the external wall and the boundary $B_2$ of the high pressure region $E_2$ formed between the guiding members 87A and 87B.

[Third Embodiment]

Figure 13:
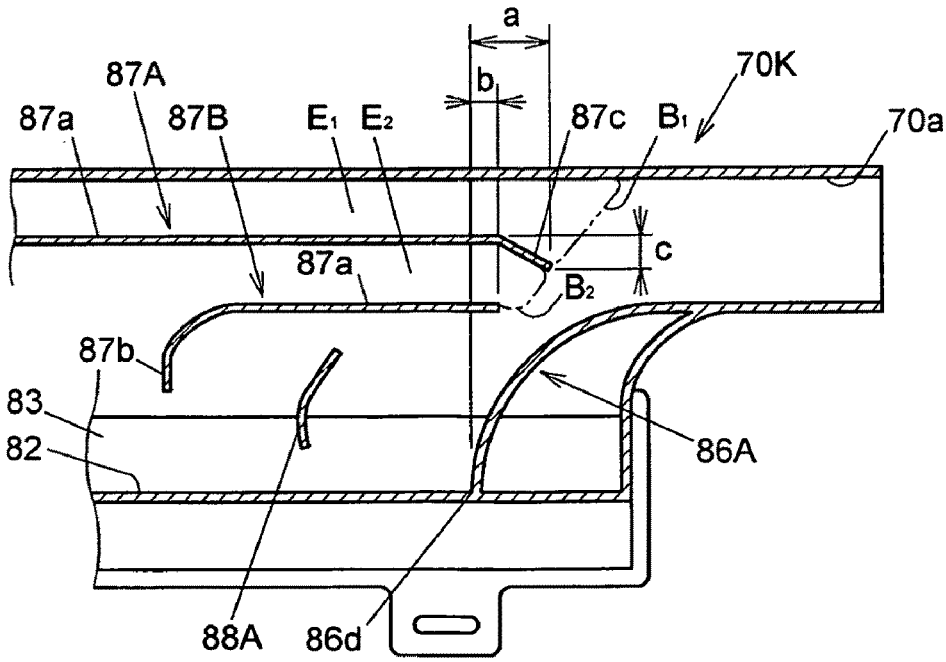
FIG. 13 is a view showing the details of an air inlet side of a blast duct in an image forming apparatus according to a third exemplary embodiment of the invention.

FIG. 13 is a view showing the details of an air inlet side of a blast duct in an image forming apparatus according to a third exemplary embodiment of the invention.

In blast ducts 70Y to 70$X_2$ according to the exemplary embodiment (only the blast duct 70K is shown), a guiding member 86A which is the closest to an air inlet 70*a* side is constituted by only a curved portion as shown in FIG. 11A. Ends on the air inlet 70*a* side in two guiding members 87A and 87B are protruded from an end 86*d* on a blast port 82 side in the guiding member 86A toward the air inlet 70*a* side by distances "a" and "b" respectively in the same manner as in the first exemplary embodiment, and the guiding member 87A which is more distant from the blast port 82 is provided with a tilted portion 87*c* which is tilted by a distance "c" toward the blast port 82 side at the air inlet 70*a* side of a straight portion 87*a*. Also in the exemplary embodiment, as described with reference to FIG. 11B, a reduction in a wind speed on the air inlet 70*a* side of the blast port 82 may be inhibited by an action of the boundary $B_1$ of the high pressure region $E_1$ formed between the guiding member 87A and the external wall and the boundary $B_2$ of the high pressure region $E_2$ formed between the guiding members 87A and 87B.

FIRST EXAMPLE

Figure 14A:
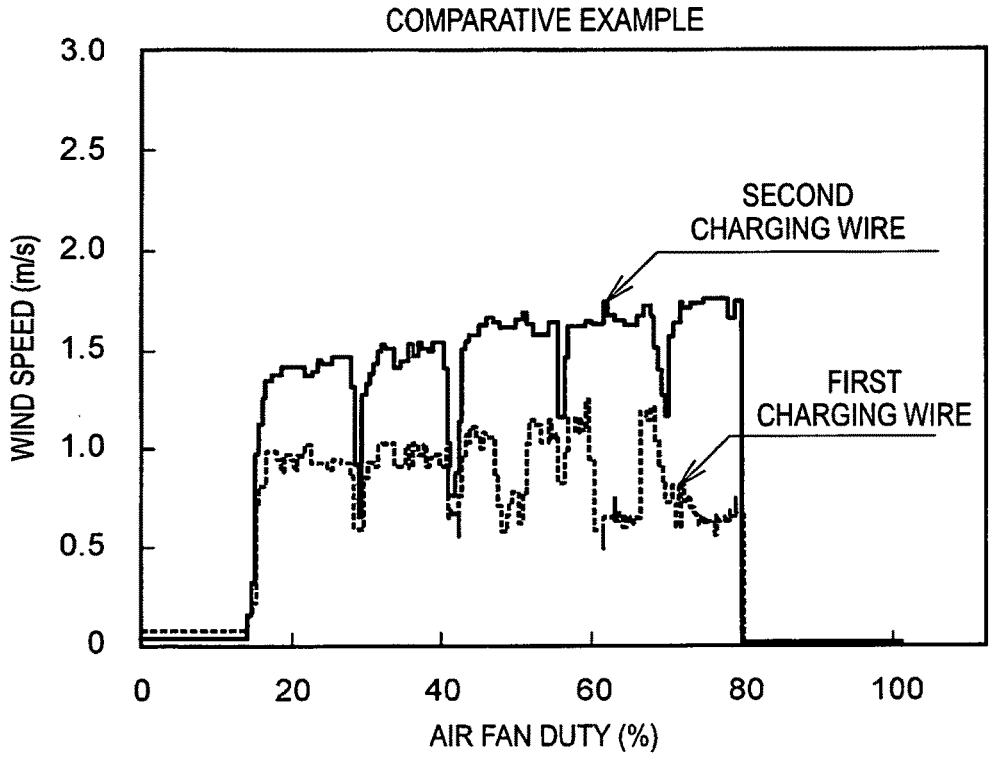
FIG. 14A is a chart showing a result of a measurement for a wind speed in the vicinity of a charging wire with an increase in an air amount of an air fan illustrated in FIG. 5 according to a comparative example and FIG. 14B is a chart showing a result of a measurement for a wind speed in the vicinity of a charging wire with an increase in an air amount of the air fan illustrated in FIG. 5 according to a first example corresponding to the first exemplary embodiment.
Figure 14B:
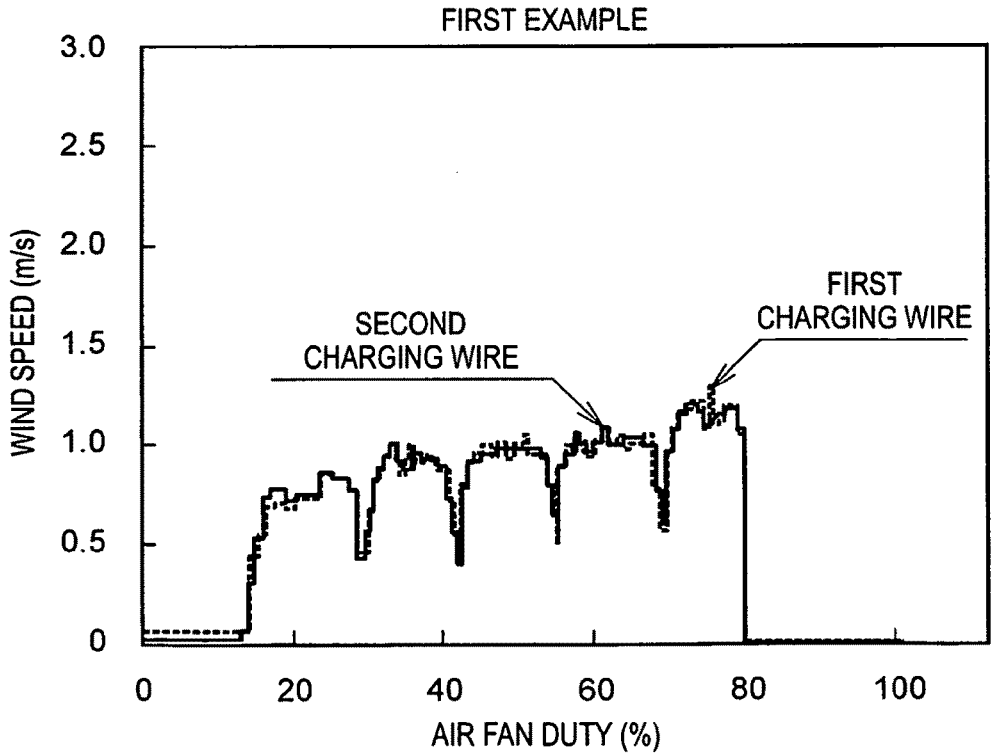

A first example according to the invention will be described with reference to FIG. 14. FIG. 14A is a chart showing a result of a measurement for a wind speed in the vicinity of the charging wire with an increase in an amount of air of the air fan illustrated in FIG. 5 according to the comparative example, and FIG. 14B is a chart showing a result of a measurement for a wind speed in the vicinity of the charging wire on the air inlet side with the increase in the amount of air of the air fan illustrated in FIG. 5 according to the first example corresponding to the first exemplary embodiment.

FIG. 14A shows a result of a measurement in the case in which the dimension "c" of the tilted portion 87*c* of the guiding member 87A is set to be 2 mm and the dimension "b" of the guiding member 87B is set to be 25 mm according to the comparative example. When a duty of the air fan 60K exceeds 60%, a great disorder occurs in the wind speed in the vicinity of the first charging wire 71A. For this reason, it is apparent that a separation of an air flow is generated in the guiding member 86A.

Moreover, it is apparent that a difference is made in the wind speed between the first and second charging wires 71A and 71B within a wide range of the duty of the air fan 60K. By setting the dimension "c" to be further greater (for example, 4 mm or 5 mm), it is hard to generate the separation of the air flow so that the difference in the wind speed between the first and second charging wires 71A and 71B tends to be reduced.

By setting the dimension "b" to be further greater (for example, 30 mm or 35 mm) in a state in which the dimension "c" is set to be 2 mm, furthermore, it is hard to generate the separation of the air flow so that the difference in the wind speed between the first and second charging wires 71A and 71B tends to be reduced.

FIG. 14B shows a result of a measurement in the case in which the dimension "c" of the tilted portion 87*c* of the guiding member 87A is set to be 2 mm and the dimension "b" of the guiding member 87B is set to be 35 mm according to the first example. Moreover, the distance "a" of the guiding member 87A to the end 86*c* of the guiding member 86A is 20 mm and an opening width of the air inlet 70*a* is 22 mm. A disorder rarely occurs in a wind speed in the vicinity of the first and second charging wires 71A and 71B within a range of 10 to 80% of a duty in the air fan 60K. For this reason, it is apparent that the separation of the air flow is not generated in the guiding member 86A. In addition, the difference in the wind speed between the first and second charging wires 71A and 71B is rarely made.

Although the image forming apparatus according to the invention has been described above based on the exemplary embodiments, the invention is not restricted to the exemplary embodiments but may be executed in various modes without departing from the gist thereof and the following changes may also be made, for example.

(1) Although the description has been given to the case in which the pair of charging wires 71A and 71B are used for each image forming portion in the exemplary embodiments, the invention is not restricted thereto but the number of the wires may be three or more.

(2) Although the description has been given to the case of an application to a printer in the exemplary embodiments, the invention is not restricted thereto but it is a matter of course that the invention is applied to a copying machine or a facsimile, and the invention may be applied to a compound machine obtained by combining at least two of the copying machine, the printer and the facsimile.

(3) Although the description has been given to the case in which the image forming apparatus 1 is a color image forming apparatus using the photosensitive drums 20Y, 20M, 20C, 20K, 20$X_1$ and 20$X_2$ in the exemplary embodiments, the invention is not restricted thereto but it is also possible to employ a monochromatic image forming apparatus using a single photosensitive drum.

(4) Although the two guiding members 87A and 87B are provided for branching the outside air flowing into the air inlet 70*a* of the blast duct into three parts in the exemplary embodiments, the outside air may be branched into four parts or more by means of at least three guiding members. In this case, it is sufficient that two guiding members which are adjacent to each other have a relationship of the second and third guiding members.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

an image carrier;

a charging member that charges a surface of the image carrier;

a blast port that is provided in almost parallel with a longitudinal direction of the charging member, outside air being sent to the charging member through the blast port;

an air inlet that is provided on one of end sides in the longitudinal direction of the charging member and takes the outside air in;

a guiding passage that guides, to the blast port, the outside air taken in through the air inlet;

a first guiding member that is provided in the closest position to an air inlet side of the guiding passage and is formed with a curve from the air inlet side to the blast port side;

a second guiding member that is provided in almost parallel with the longitudinal direction of the charging member in the guiding passage; and a third guiding member that is provided on the blast port side from the second guiding member in almost parallel with the longitudinal direction of the charging member in the guiding passage, wherein the first guiding member is closer to an air inlet side of the guiding passage than the second guiding member and the third guiding member, and wherein an end on the air inlet side of the second guiding member is positioned on the air inlet side from an end on the air inlet side of the third guiding member and a part of the second and third guiding members is provided to overlap with the first guiding member in the longitudinal direction of the charging member.

2. The image forming apparatus according to claim 1, wherein a tilted portion tilted to the blast port side is provided on the end at the air inlet side of the second guiding member.

3. The image forming apparatus according to claim 1, wherein the first guiding member is constituted by a straight portion, a first curved portion connected to the air inlet side of the straight portion, and a second curved portion connected to an opposite side to a side of the straight portion to which the first curved portion is connected, and the first and second curved portions satisfy a relationship of $\theta_1<\theta_3$, wherein a smaller one of angles formed by two tangential lines in the first curved portion is represented by $\theta_1$ and a smaller one of angles formed by two tangential lines in the second curved portion is represented by $\theta_3$.

4. The image forming apparatus according to claim 3, wherein the first to third guiding members satisfy a relationship of $\theta_2>\theta_1$, wherein an angle of the straight portion of the first guiding member with respect to the longitudinal direction of the charging member is represented by $\theta_1$ and an angle of a line connecting an end of the tilted portion in the second guiding member and the end on the air inlet side of the third guiding member with respect to the longitudinal direction of the charging member is represented by $\theta_2$.

5. An air outlet apparatus comprising;

a blast port that is provided in almost parallel with a longitudinal direction of a member, outside air being sent to the member through the blast port;

an air inlet that is provided on one of end sides in the longitudinal direction of the member and takes the outside air in;

a guiding passage that guides, to the blast port, the outside air taken in through the air inlet;

a first guiding member that is provided in the closest position to an air inlet side of the guiding passage and is formed with a curve from the air inlet side to the blast port side;

a second guiding member that is provided in almost parallel with the longitudinal direction of the member in the guiding passage; and a third guiding member that is provided on the blast port side from the second guiding member in almost parallel with the longitudinal direction of the member in the guiding passage, wherein the first guiding member is closer to an air inlet side of the guiding passage than the second guiding member and the third guiding member, and wherein an end on the air inlet side of the second guiding member is positioned on the air inlet side from an end on the air inlet side of the third guiding member and a part of the second and third guiding members is provided to overlap with the first guiding member in the longitudinal direction of the member.

6. The air outlet apparatus according to claim 5, wherein a tilted portion tilted to the blast port side is provided on the end at the air inlet side of the second guiding member.

7. The air outlet apparatus according to claim 5, wherein the first guiding member is constituted by a straight portion, a first curved portion connected to the air inlet side of the straight portion, and a second curved portion connected to an opposite side to a side of the straight portion to which the first curved portion is connected, and the first and second curved portions satisfy a relationship of $\theta_1<\theta_3$, wherein a smaller one of angles formed by two tangential lines in the first curved portion is represented by $\theta_1$ and a smaller one of angles formed by two tangential lines in the second curved portion is represented by $\theta_3$.

8. The air outlet apparatus according to claim 7, wherein the first to third guiding members satisfy a relationship of $\theta_2>\theta_1$, wherein an angle of the straight portion of the first guiding member with respect to the longitudinal direction of the member is represented by $\theta_1$ and an angle of a line connecting an end of the tilted portion in the second guiding member and the end on the air inlet side of the third guiding member with respect to the longitudinal direction of the member is represented by $\theta_2$.

9. The air outlet apparatus according to claim 5, wherein the member is a charging member charging a surface of an image carrier.

* * * * *